US006513224B1

(12) United States Patent
Chen et al.

(10) Patent No.: US 6,513,224 B1
(45) Date of Patent: Feb. 4, 2003

(54) BELT FABRICATION METHOD

(76) Inventors: Mike Chien-Fang Chen, No. 17, Kung 6 Road, Linkou 2nd Industrial Park, Taipei Hsien (TW); Stan M. Jurga, P.O. Box 1356, One Main St., Shirley, MA (US) 01464

( * ) Notice: Subject to any disclaimer, the term of this patent is extended or adjusted under 35 U.S.C. 154(b) by 0 days.

(21) Appl. No.: 09/908,724

(22) Filed: Jul. 20, 2001

(51) Int. Cl.[7] ..... B23P 21/00; A41F 9/00

(52) U.S. Cl. ..... 29/469; 2/322

(58) Field of Search ..... 29/469; 2/322, 2/336, 321, 311, 338; 24/265 BC, 265 A, 182, 178; 264/39, 27, 37, 33; 425/542

(56) References Cited

U.S. PATENT DOCUMENTS 1,973,646 A * 2/1934 Mix
6,049,951 A * 4/2000 Anscher ..... 24/265

* cited by examiner

*Primary Examiner*—David P. Bryant
*Assistant Examiner*—John C. Hong
(74) *Attorney, Agent, or Firm*—Varndell & Varndell, PLLC

(57) ABSTRACT

A belt fabrication method includes the steps of tailpiece formation procedure, keeper and belt head formation procedure, belt body formation procedure, and final fixation procedure. During the keeper and belt head formation procedure, a split is formed in one end of the headpiece, so that the front end of the belt body can be engaged into the split of the headpiece and then fixedly fastened to the headpiece by stitches.

1 Claim, 4 Drawing Sheets

BELT FABRICATION METHOD

BACKGROUND AND SUMMARY OF THE INVENTION

The present invent relates to a belt fabrication method for the fabrication of belts for casual wear.

A variety of belts for casual wear are commercially available. In order to fit different waistlines, different sizes of belts are provided. U.S. Pat. No. 5,873,133 discloses a belt fabrication method for the fabrication of belts for casual wear. However, this method is not suitable for the fabrication of belts subject to fixed lengths.

The present invention provides a belt fabrication method, which greatly shortens belt fabrication speed and reduces the consumption of labor. Further, the belt fabrication method is suitable for the fabrication of belts subject to fixed lengths. The belt fabrication method includes the steps of tailpiece formation procedure, keeper and belt head formation procedure, belt body formation procedure, and final fixation procedure. During the keeper and belt head formation procedure, a split is formed in one end of the headpiece, so that the front end of the belt body can be engaged into the split of the headpiece and then fixedly fastened to the headpiece by stitches.

DETAILED DESCRIPTION OF THE PREFERRED EMBODIMENT

Figure 1:
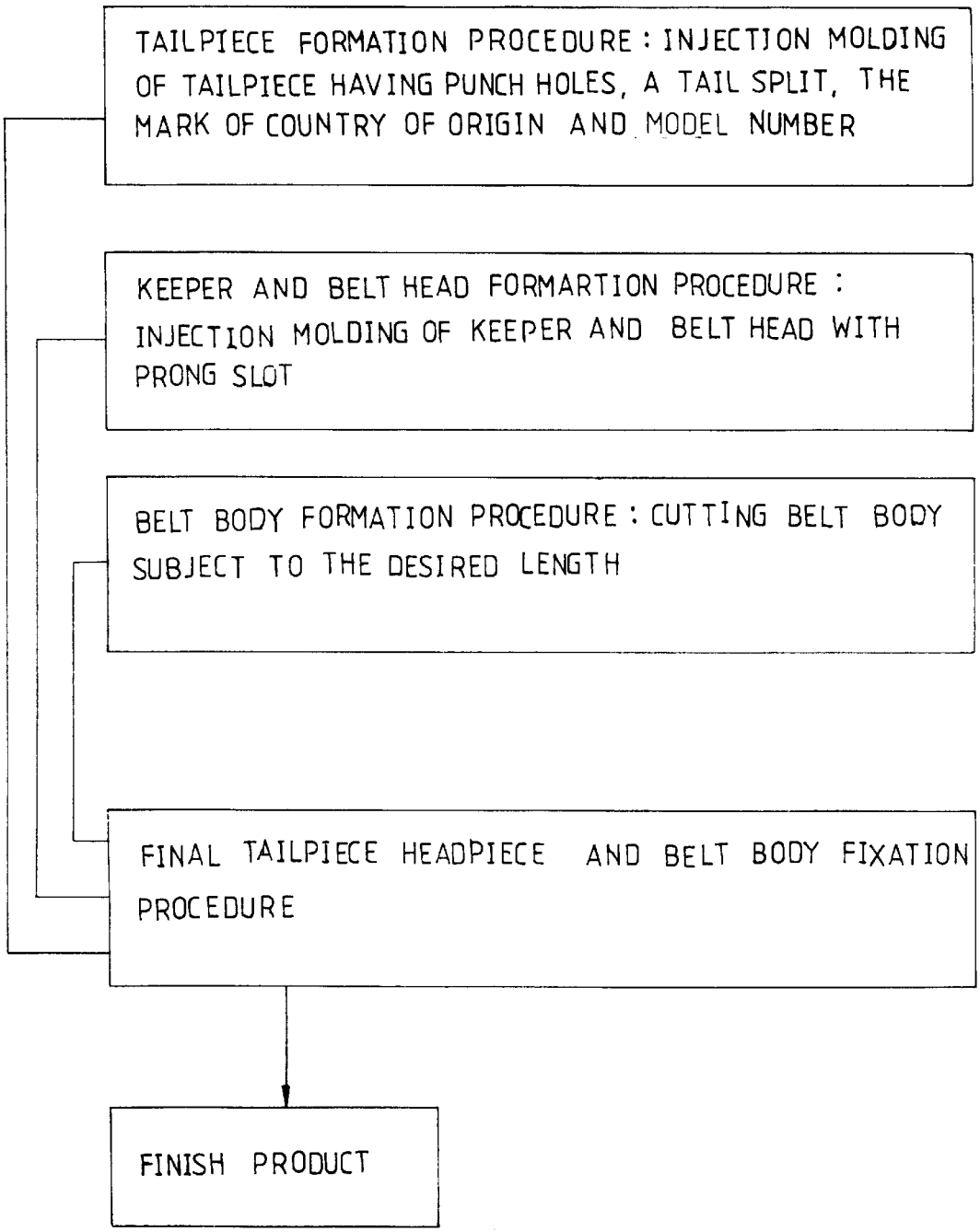
FIG. 1 is a belt fabrication flow chart according to the present invention.
Figure 2:
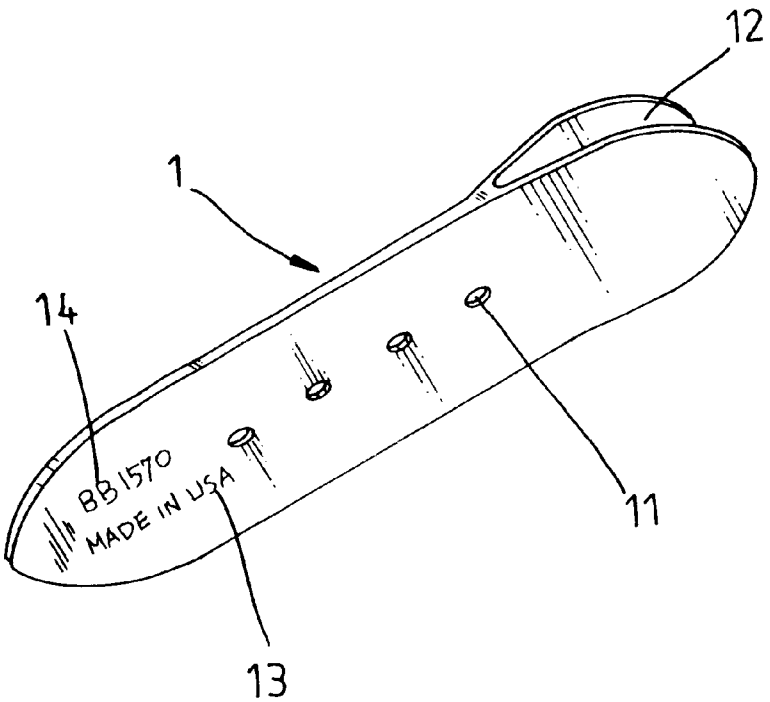
FIG. 2 illustrates a tailpiece made according to the present invention.
Figure 3:
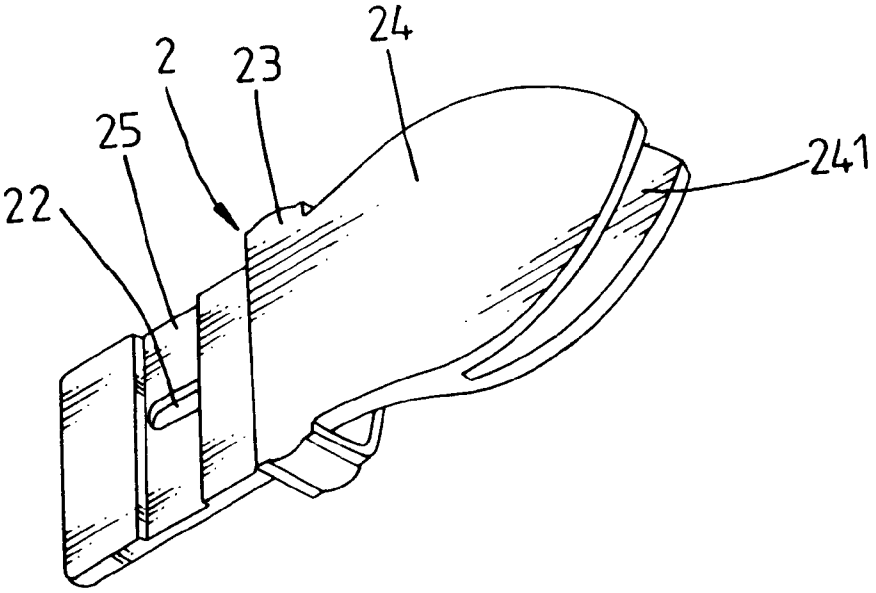
FIG. 3 illustrates a headpiece made according to the present invention.
Figure 4:
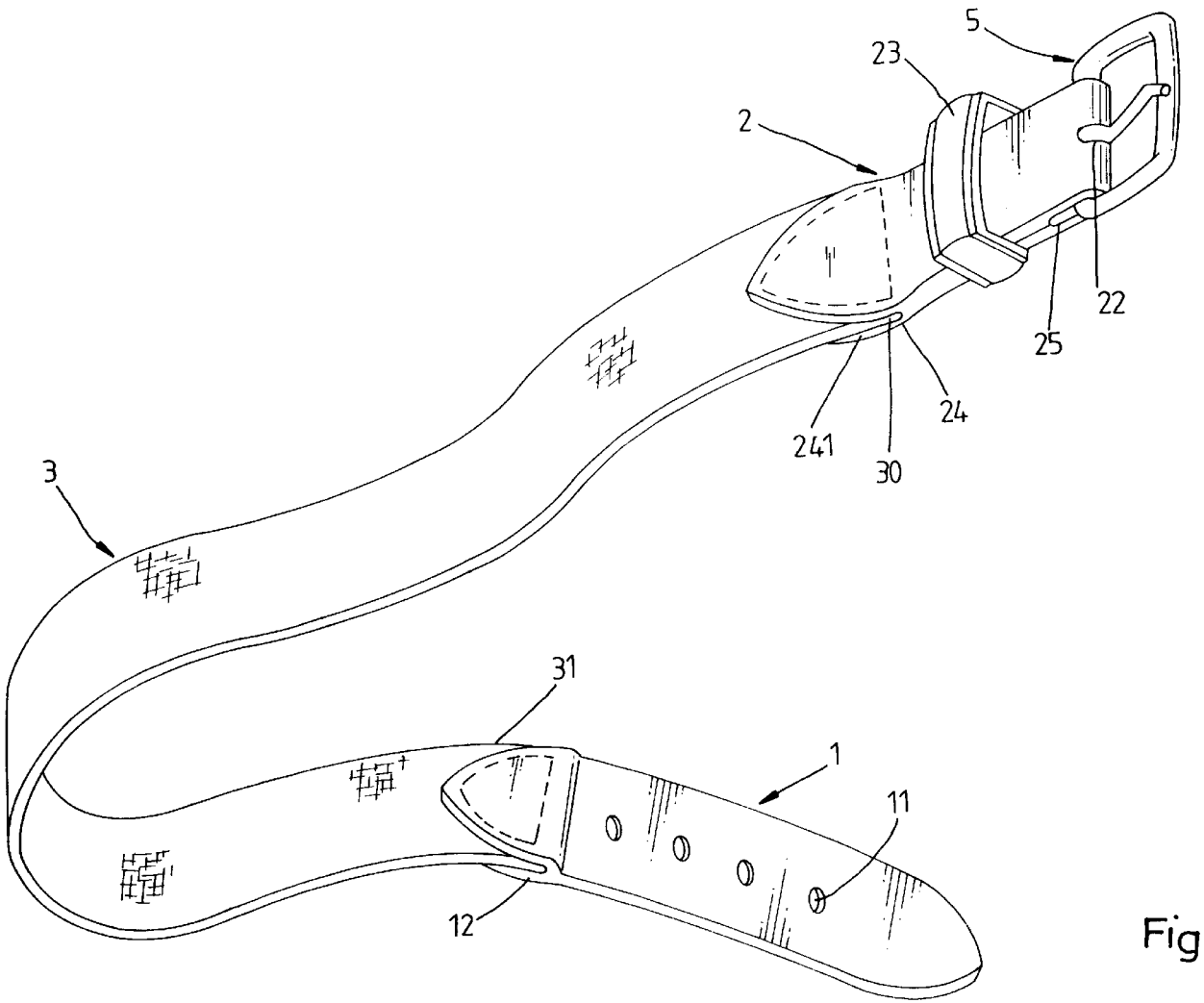
FIG. 4 is a perspective view of a belt made according to the present invention.

Referring to FIGS. from 1 through 4, a belt fabrication method in accordance with the present invention comprises the step of tailpiece formation procedure where a tailpiece 1 is made having a longitudinal series of punch holes 11, a tail split 12, the mark of country of origin 13 and model number 14 (see FIG. 2), the step of keeper and belt head formation procedure where a headpiece 2 is made and fixedly fastened to a buckle 5 by stitches and a keeper 23 is formed integral with the headpiece 2 (see FIG. 3), the step of belt body formation procedure where a belt body 3 is prepared subject to a predetermined length, and the step of final fixation procedure where the front end 30 of the belt body 3 is fixedly fastened to the headpiece 2 by stitches, the rear end 31 of the belt body 3 is engaged into the split 12 and fixedly secured to the tailpiece 1 by stitches (see FIG. 4). The tailpiece 1 is injection-molded from flexible plastic material. After injection molding, the punch holes 11, the split 12 and the mark of country of origin 13 and model number 14 are formed on the tailpiece 1. During the aforesaid keeper and belt head formation procedure, the keeper 23 and the headpiece 2 are integrally injection-molded from flexible plastic material. After the formation of the headpiece 2 and the keeper 23, a prong slot 22 is formed on the headpiece 2 for the insertion of the prong of the buckle 5, and the headpiece 2 has thinner panel wall portions 24, 25 so that the headpiece 2 can be conveniently turned and inserted through the buckle 5 and then fixedly fastened to the buckle 5 stitches.

During the aforesaid keeper and belt head formation procedure, a split 241 is formed in one end of the headpiece 2, so that the front end 30 of the belt body 3 can be engaged into the split 241 and then fixedly fastened to the headpiece 2 by stitches.

During the fabrication of the belt, the belt body 3 is properly cut subject to the desired length.

What is claimed is:

1. A belt fabrication method comprising the steps of:

injection-molding a flexible plastic material into a tailpiece;

forming a longitudinal series of punch holes, a tail split, and markings of country of origin and model number on the tailpiece;

injection-molding a flexible plastic material into a headpiece with a keeper;

forming a prong slot in the headpiece;

forming a split in one end of said headpiece;

fastening a buckle to the headpiece by stitches;

preparing a belt body having a front end and a rear end;

fastening the front end of the belt body within the split of the headpiece by stitches, and fastening the rear end of the belt body within the split of the tailpiece by stitches.

* * * * *